US007579571B2

(12) United States Patent
Siebens et al.

(10) Patent No.: US 7,579,571 B2
(45) Date of Patent: Aug. 25, 2009

(54) VISIBLE OPEN INDICATOR

(75) Inventors: Larry Siebens, Asbury, NJ (US); Frank M. Stepniak, Hackettstown, NJ (US)

(73) Assignee: Thomas & Betts International, Inc., Wilmington, DE (US)

( * ) Notice: Subject to any disclaimer, the term of this patent is extended or adjusted under 35 U.S.C. 154(b) by 155 days.

(21) Appl. No.: 11/512,015

(22) Filed: Aug. 29, 2006

(65) Prior Publication Data

US 2007/0278187 A1 Dec. 6, 2007

Related U.S. Application Data

(60) Provisional application No. 60/809,696, filed on May 31, 2006.

(51) Int. Cl.
*H01H 9/16* (2006.01)

(52) U.S. Cl. ..... 218/120; 218/140; 200/308

(58) Field of Classification Search ..... 218/7, 218/14, 84, 120, 134, 139, 140, 153–155; 200/50.01, 50.02, 50.26, 308–312, 330, 331, 200/400, 401

See application file for complete search history.

(56) References Cited

U.S. PATENT DOCUMENTS

| | | | | |
|---|---|---|---|---|
| 3,399,286 | A | 8/1968 | Kerr | |
| 3,956,721 | A | 5/1976 | Link | |
| 4,124,790 | A | 11/1978 | Kumbera et al. | |
| 4,150,270 | A | 4/1979 | Zunick | |
| 4,220,942 | A | 9/1980 | Meister et al. | |
| 4,323,874 | A | 4/1982 | Link | |
| 4,484,046 | A | 11/1984 | Neuhouser | |
| 4,568,804 | A | 2/1986 | Luehring | |
| 4,645,888 | A * | 2/1987 | Barkan et al. | 200/83 W |
| 4,799,895 | A | 1/1989 | Borgstrom | |
| 4,865,559 | A | 9/1989 | Clabburn | |
| 4,955,823 | A | 9/1990 | Luzzi | |
| 5,578,805 | A * | 11/1996 | Berger et al. | 218/43 |
| 5,641,306 | A | 6/1997 | Stepniak | |
| 5,667,060 | A | 9/1997 | Luzzi | |
| 5,795,180 | A | 8/1998 | Siebens | |
| 5,808,258 | A | 9/1998 | Luzzi | |
| 5,864,942 | A | 2/1999 | Luzzi | |
| 5,912,604 | A * | 6/1999 | Harvey et al. | 335/9 |

(Continued)

FOREIGN PATENT DOCUMENTS

WO WO 03/096504 A1 11/2003

*Primary Examiner*—Elvin G Enad
*Assistant Examiner*—Marina Fishman
(74) *Attorney, Agent, or Firm*—Hoffmann & Baron, LLP

(57) ABSTRACT

A visible open indicator for high voltage vacuum interrupters and switches, which use a vacuum bottle having a high voltage contact and an actuating element that opens and closes the contact, is provided. The visible open indicator includes: an actuating mechanism that operates the actuating element; a housing that contains the actuating mechanism; an indicator attached to the actuating mechanism, wherein the indicator shows that the contact is in an open position or closed position; a viewing window extending through the housing, wherein the viewing window is aligned with the indicator so that the indicator can be viewed through the viewing window. The indicator includes a first indicating portion and a second indicating portion. The first indicating portion is visible through the viewing window when the contact is open and the second indicating portion is visible through the viewing window when the contact is closed.

18 Claims, 7 Drawing Sheets

U.S. PATENT DOCUMENTS

| | | | |
|---|---|---|---|
| 5,957,712 | A | 9/1999 | Stepniak |
| 6,168,447 | B1 | 1/2001 | Stepniak et al. |
| 6,213,799 | B1 | 4/2001 | Jazowski et al. |
| 6,491,548 | B2 | 12/2002 | Stepniak et al. |
| 6,504,103 | B1 | 1/2003 | Meyer et al. |
| 6,585,531 | B1 | 7/2003 | Stepniak et al. |
| 6,825,426 | B2 | 11/2004 | Muench et al. |
| 6,843,685 | B1 | 1/2005 | Borgstrom et al. |
| 6,939,151 | B2 | 9/2005 | Borgstrom et al. |
| 6,984,791 | B1 | 1/2006 | Meyer et al. |

* cited by examiner

VISIBLE OPEN INDICATOR

This application claims priority from provisional application Ser. No. 60/809,696, filed on May 31, 2006.

FIELD OF THE INVENTION

The present invention relates to separable electrical connectors and, more particularly, to improvements in separable electrical connectors such as loadbreak connectors and deadbreak connectors, including a visible open indicator for determining the switch position.

BACKGROUND OF INVENTION

High voltage switch assemblies with sub-atmospheric or vacuum type circuit interrupters for electric power circuits and systems are well known in the art, such as is shown in U.S. Pat. Nos. 4,568,804; 3,955,167 and 3,471,669. Encapsulated vacuum type switches or circuit breakers are also known, as is shown in U.S. Pat. Nos. 3,812,314 and 2,870,298.

Insulated switches using vacuum bottles do not provide means for visual inspection of the contacts to confirm that they are open (visible break) or closed. Prior art switches were designed with contacts in a large gas or oil filled cabinet which allowed a glass window to be installed for viewing the contacts. However, there is no means of directly viewing contacts in vacuum bottles since the bottles are made of metal and ceramic nontransparent materials. The seals required to maintain the vacuum inside the vacuum bottle prohibit the installation of a glass window.

In most switch assemblies and circuit breakers, a pair of contacts acting in cooperation, one fixed and the other movable, are provided for controlling and interrupting current flow. The contacts are housed in a controlled atmosphere contact assembly that includes a glass or ceramic housing, commonly referred to as a "bottle." A metal bellows is provided on one end of the bottle, and the movable contact is linked to the inside of the bellows. An operating rod attached to the outside of the bellows is moved in order to actuate the movable contact inside the bottle. The interior of the bottle is maintained under a controlled atmosphere, such as air under a low sub-atmospheric pressure, to protect the contacts from damage caused by arcing when the contacts are opened and closed. The glass or ceramic wall of the bottle provides a permeation-resistant enclosure that maintains the controlled atmosphere for the life of the device. Newer high voltage switches combine vacuum switching with high dielectric strength EPDM rubber insulation as described in U.S. Pat. Nos. 5,667,060; 5,808,258; and 5,864,942 to Luzzi, all of which are incorporated herein in their entirety.

Switches that have viewing windows are usually SF6 gas insulated vacuum bottle type switches. In all cases, the contacts within the vacuum bottle are not visible due to the method of construction. A user can view the actuating mechanism through the gas and determine if the mechanism has moved open or closed. This provides a visible indication of the switch position. However, the eventual unavailability of SF6 gas as an insulator due to government regulations and ozone issues is a major disadvantage for the prior art devices. In addition, prior art devices are susceptible to leaks and they have had problems maintaining the SF6 gas within the switch.

The handle positions for prior art switches indicate the position of the contacts in the vacuum bottle. A pointer on the handle indicates closed when pointing in one direction and open when pointing in the other direction. The connection from the handle to the bottle includes a plurality of components which form a linkage. If these components do not function properly, the position of the pointer may not correctly indicate the position of the contacts.

In contrast to the handles on switches, the handle position of an interrupter does not always indicate the contact position even when the actuating mechanism is operating properly. Therefore, interrupters typically have a viewing indicator instead of a pointer. The handle of an interrupter is usually in one direction for closed and the other direction for open. However, the handle can be in the closed position with the contacts open when the interrupter trips due to an over current event. Under these circumstances, the prior art viewing indicator shows that the contact is open but the handle is in the closed position. This is similar to the circuit breakers in a house. When the breaker trips, the handle does not move all the way to the open position and it is necessary to move the handle to the open position in order to reset the mechanism before it can be closed. The linkage from the vacuum bottle to the viewing indicator of the interrupter also includes numerous components (see FIG. 1C), which are subject to failure and a false indication.

Typically, prior art insulated switches using vacuum technology are sealed inside the vacuum bottle and hidden from view. The voltage source and the load are connected to the switch but the switch contacts are not visible. The only means for determining the status of the switch contacts is the position of the switch handle. If the linkage between the handle and the switch contacts is inoperative or defective, there is no positive indication that allows the operating personnel to determine the position of the contacts. This can result in false readings which can be very dangerous to anyone operating the switch or working on the lines. Accordingly, the industry has recognized the need for insulated switches using vacuum bottles that provide a reliable indication of the position of the contacts.

SUMMARY OF THE INVENTION

In accordance with the present invention, a visible open indicator for high voltage vacuum interrupters and switches, which use a vacuum bottle having a high voltage contact and an actuating element that opens and closes the contact, is provided. The visible open indicator includes: an actuating mechanism that operates the actuating element; a housing that contains the actuating mechanism; an indicator attached to the actuating mechanism, wherein the indicator shows that the contact is in an open position or closed position; a viewing window extending through the housing, wherein the viewing window is aligned with the indicator so that the indicator can be viewed through the viewing window. The housing can be constructed from a solid dielectric material, preferably EPDM rubber.

The indicator includes a first indicating portion and a second indicating portion. The first indicating portion is visible through the viewing window when the contact is open and the second indicating portion is visible through the viewing window when the contact is closed. The actuating mechanism can include a linkage formed by a plurality of components. In preferred embodiments, the actuating mechanism includes a first end and a second end and the actuating mechanism is connected to the actuating element on the first end and a handle on the second end. In a most preferred embodiment, the actuating mechanism includes an assembly that connects the indicator to the actuating element. In one embodiment, the assembly can include a connector and an insulated rod. In another embodiment, the assembly consists essentially of a connector, a screw and an insulated rod.

The high voltage vacuum interrupters and switches can include an inlet connection for a voltage load having a first centerline and the viewing window can have a second centerline. The distance between the two centerlines is kept to a minimum, preferably less than 6 inches and more preferably less than 5 inches. In addition, the housing is preferably made from a solid dielectric material.

BRIEF DESCRIPTION OF THE FIGURES

The preferred embodiments of the visible open indicator for high voltage vacuum interrupters and switches of the present invention, as well as other objects, features and advantages of this invention, will be apparent from the following detailed description, which is to be read in conjunction with the accompanying drawings wherein.

DETAILED DESCRIPTION OF THE INVENTION

Figure 1A:
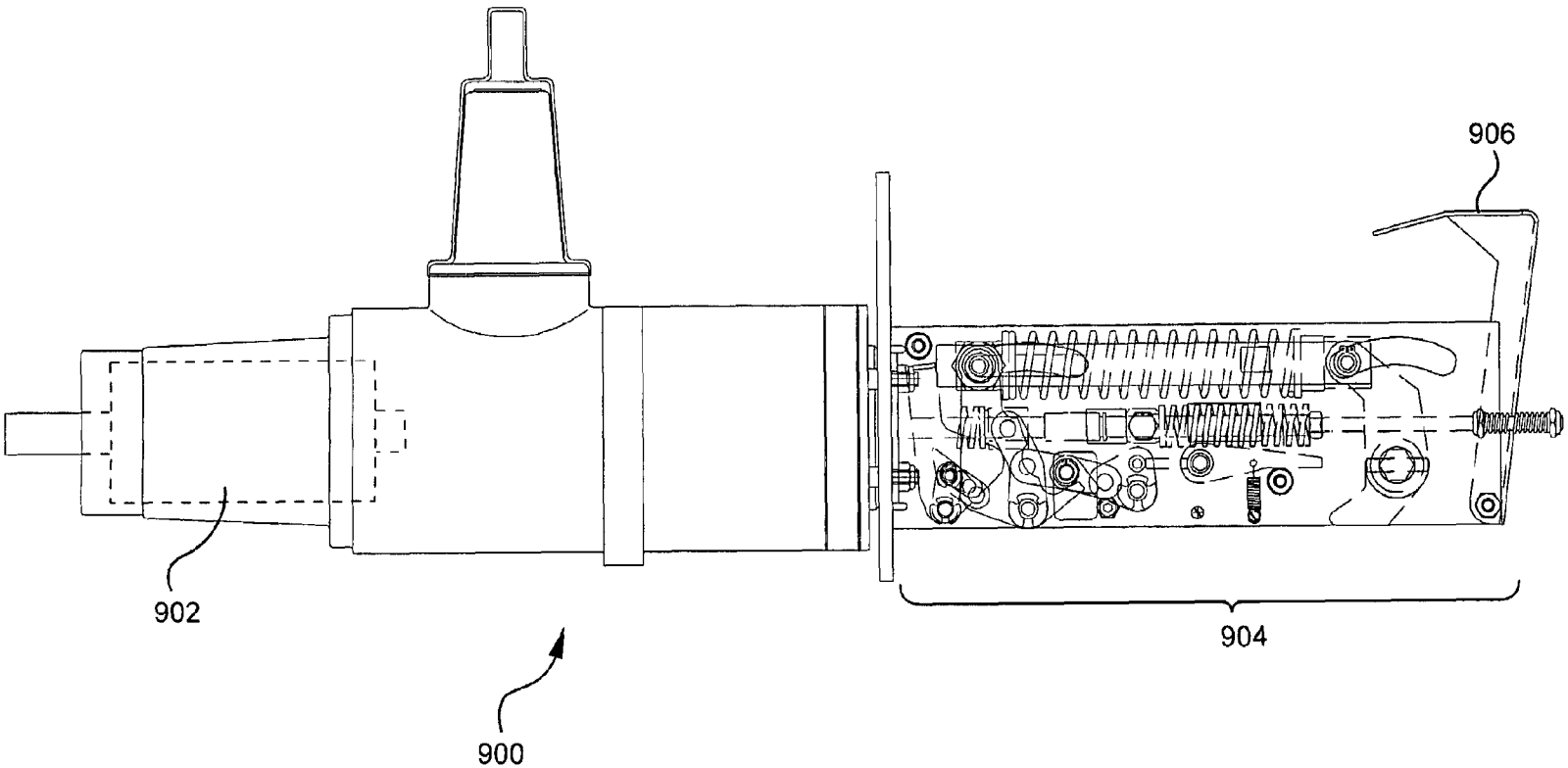
FIG. 1A Prior Art
FIG. 1A is a side view of a prior art high voltage switch in a vacuum bottle with an actuating mechanism operating a position indicator for the contacts.

The present invention provides visual indication of the position of high voltage contacts sealed in a vacuum bottle for switches and interrupters. The contacts cannot be viewed directly through the nontransparent wall of the vacuum bottle and, therefore, it is necessary to locate the visual indicator on the outside of the bottle. The housings for some prior art switches are constructed of solid dielectric materials, such as ethylene propylene diene monomer ("EPDM") rubber, and position indicators on the outside of the housing indicate when the switch is in the open or closed position. In order to move the indicator, numerous components in the linkage (FIG. 1C) that connects the vacuum bottle actuating element and the indicator must function correctly.

The present invention improves the reliability by moving the viewing window closer to the vacuum bottle and using fewer connections between the vacuum bottle actuating element and the indicator. In preferred embodiments, maximum reliability is provided by moving the viewing window as close to the vacuum bottle as the electrical field will allow. This reduces the number of actuating mechanism components between the vacuum bottle contacts and the viewing window to a minimum. Consequently, the risk of a connection failure or a false reading is significantly reduced.

The visible open indicator of the present invention is used with high voltage vacuum interrupters and switches that include a high voltage contact in a vacuum bottle. The vacuum bottle is provided with an actuating element that opens and closes the contact. The actuating element has a shaft that extends outside the vacuum bottle and passes through one or more seals, which maintain the vacuum inside the bottle. An actuating mechanism, which is external to the vacuum bottle, operatively connects to the actuating element. (See U.S. Pat. Nos. 5,667,060; 5,808,258; and 5,864,942 to Luzzi.) The actuating mechanism includes a linkage that has a plurality of components and that can be connected to a handle for manual opening and closing the contacts and/or a motor operator. The actuating mechanism is enclosed in a housing and provided with a viewing window that allows the actuating mechanism to be viewed through the wall of the housing. The viewing window is sealably installed in an aperture in the wall of the housing using methods well know to those skilled in the art, preferably using a sealant such as an epoxy.

An indicator is attached to the actuating mechanism and aligned so that its location corresponds to the location of the viewing window. When the actuating mechanism closes the contacts, the indicator is moved towards the vacuum bottle. When the actuating mechanism opens the contacts, the indicator is moved away from the vacuum bottle. In a preferred embodiment, the indicator is provided with a first indicating portion or indicia for the open contact position and a second indicating portion or indicia for the closed contact position. Most preferably, the first indicia is a green indicator for an open contact and a red indicator for a closed contact. The viewing window and the indicator are designed so that the first indicating portion is visible through the viewing window when the contact is open and the second indicating portion is visible through the viewing window when the contact is closed.

In another preferred embodiment, the actuating mechanism includes an assembly that connects the indicator to the actuating element and a first end connected to the actuating element and a second end connected to a handle. The assembly includes a connector and an insulated rod and, more preferably, a connector, a screw and an insulated rod. The indicator is preferably attached to the first connector at a minimum distance from the actuating element. This reduces the number of actuating mechanism components between the actuating element and the indicator and provides greater reliability. The housing for the actuating mechanism can be constructed from a solid dielectric material; preferably, a hard rubber material and, most preferably, EPDM rubber. The aperture for the viewing window is formed either when the housing is fabricated using methods well know to those skilled in the art, such as injection molding, or after the housing is formed by cutting or drilling an opening that extends through the wall of the housing.

The visible open indicator of the present invention can be used with either a high voltage vacuum interrupter or a high voltage switch, which has an inlet connection with a first centerline for the high voltage source. The viewing window is located in an aperture in the actuating mechanism housing that is connected to the interrupter or switch. The aperture/viewing window has a second center line that is less than 6 inches from the first centerline and, preferably, less than 5 inches. Of course, actual distances may vary.

Figure 1B:
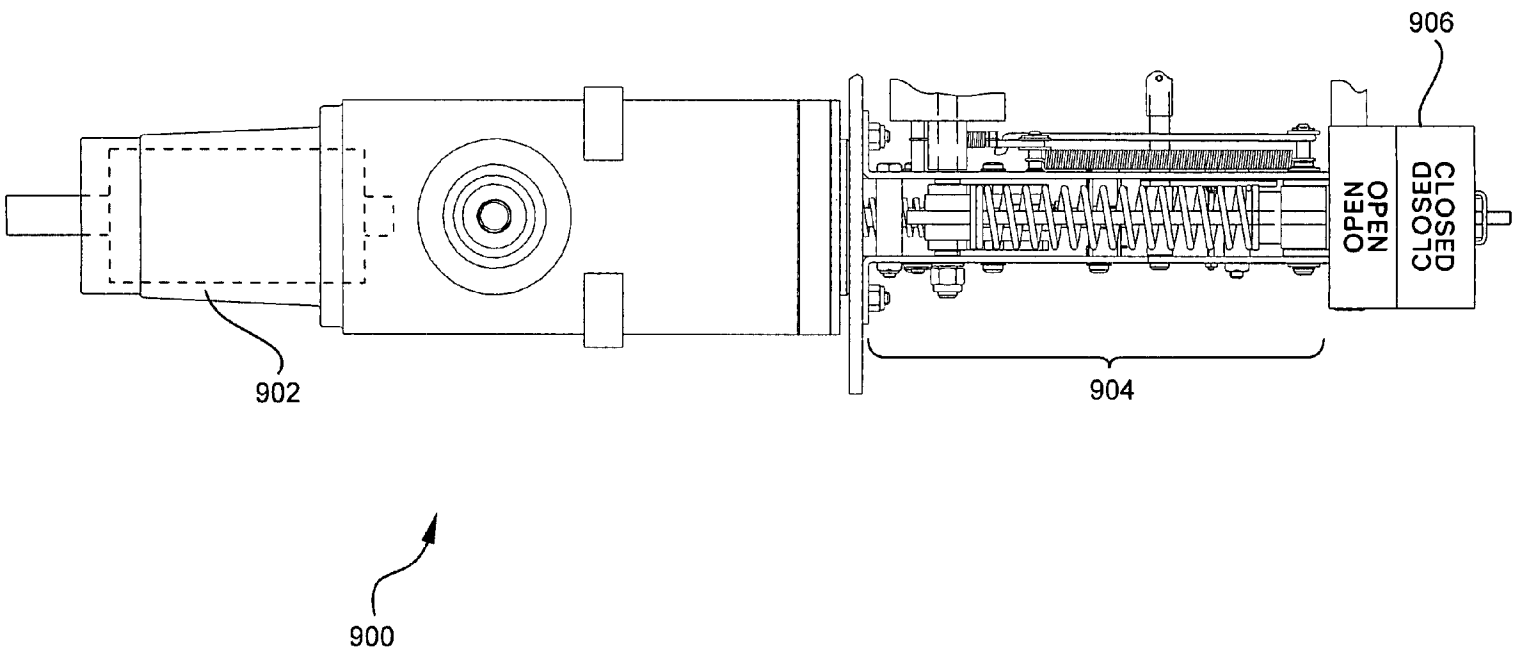
FIG. 1B Prior Art
FIG. 1B is a plan view of a prior art high voltage switch in a vacuum bottle with an actuating mechanism operating a position indicator for the contacts.
Figure 1C:
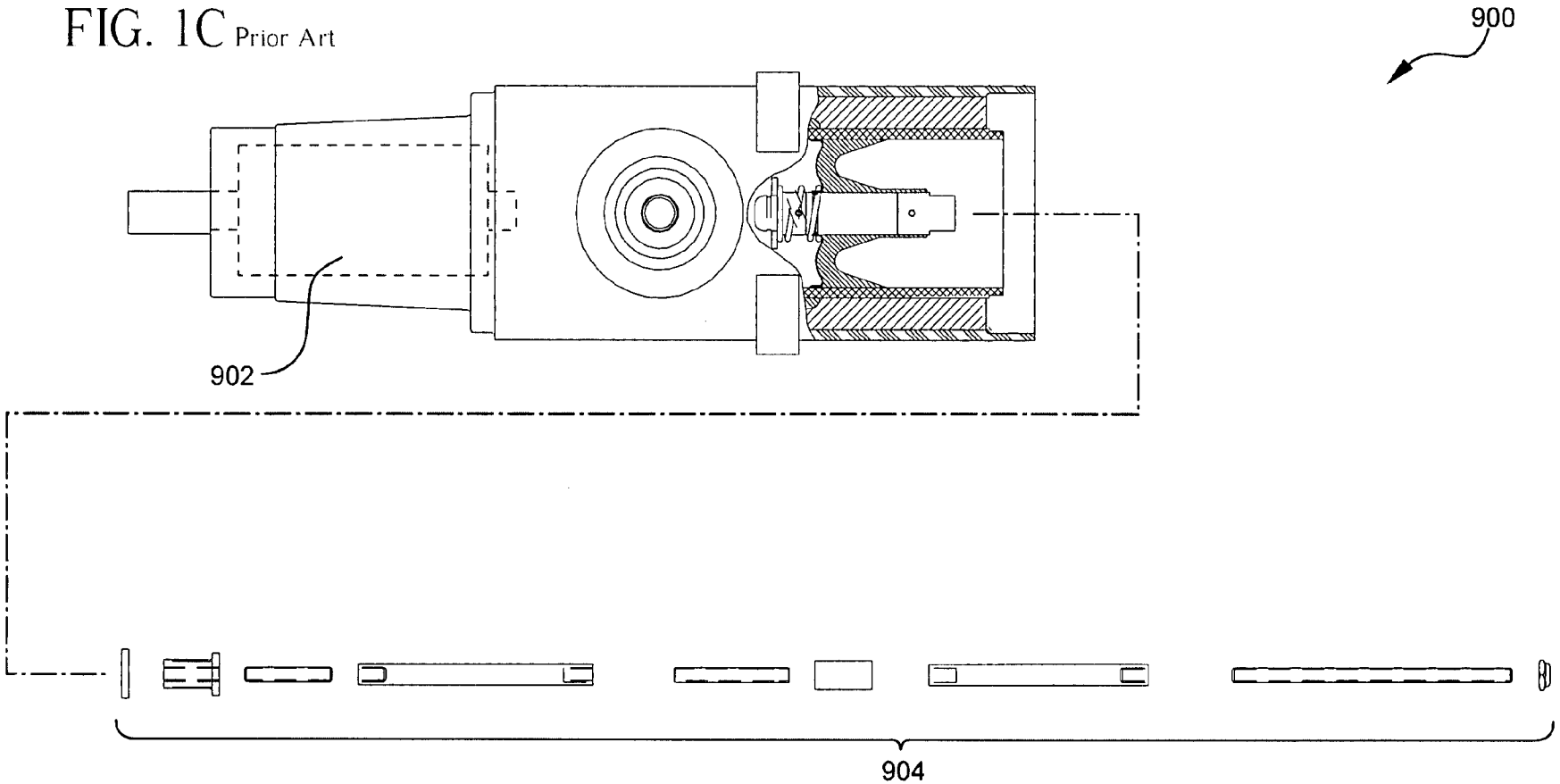
FIG. 1C Prior Art
FIG. 1C is the prior art high voltage switch illustrated in FIG. 1A with an exploded view of the actuating mechanism.

FIG. 1A and FIG. 1B show a prior art high voltage vacuum switch 900 having a vacuum bottle 902 and an actuating mechanism 904. The position of the contacts is shown by an open-closed indicator 906 at the end of the actuating mechanism 904. The actuating mechanism 904 includes numerous components and connections which may fail or malfunction and cause a false indication of the position of the contact. This can cause accidents and places the health of operating and maintenance personnel in jeopardy. FIG. 1C is an exploded view of the actuating mechanism 904 and shows the numerous components and connections in detail. The present invention provides a more reliable indicator by eliminating many of these components and connections.

Figure 2:
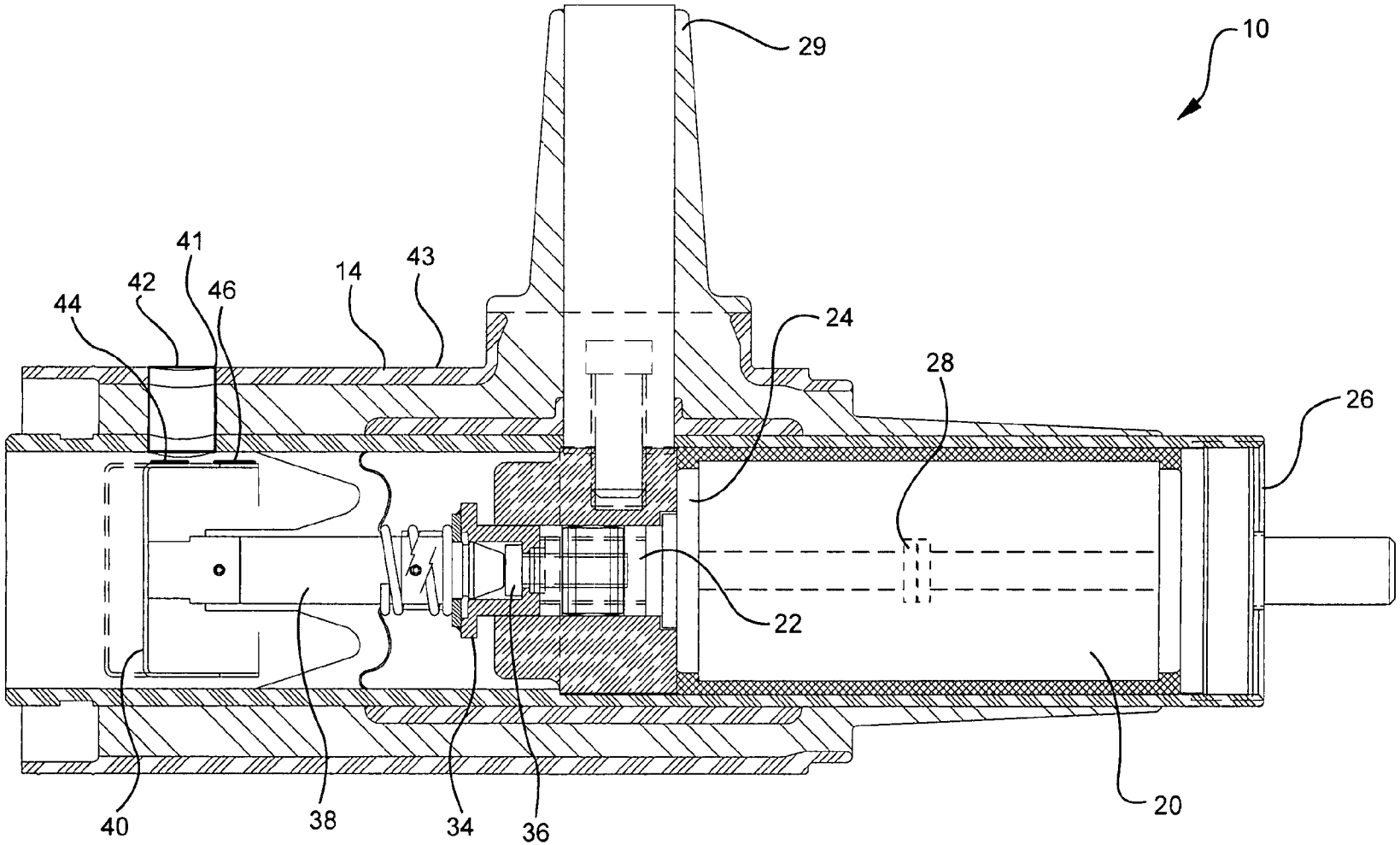
FIG. 2 is a sectional view of the visible open indicator showing the contact in the vacuum bottle and position indicator.
Figure 3:
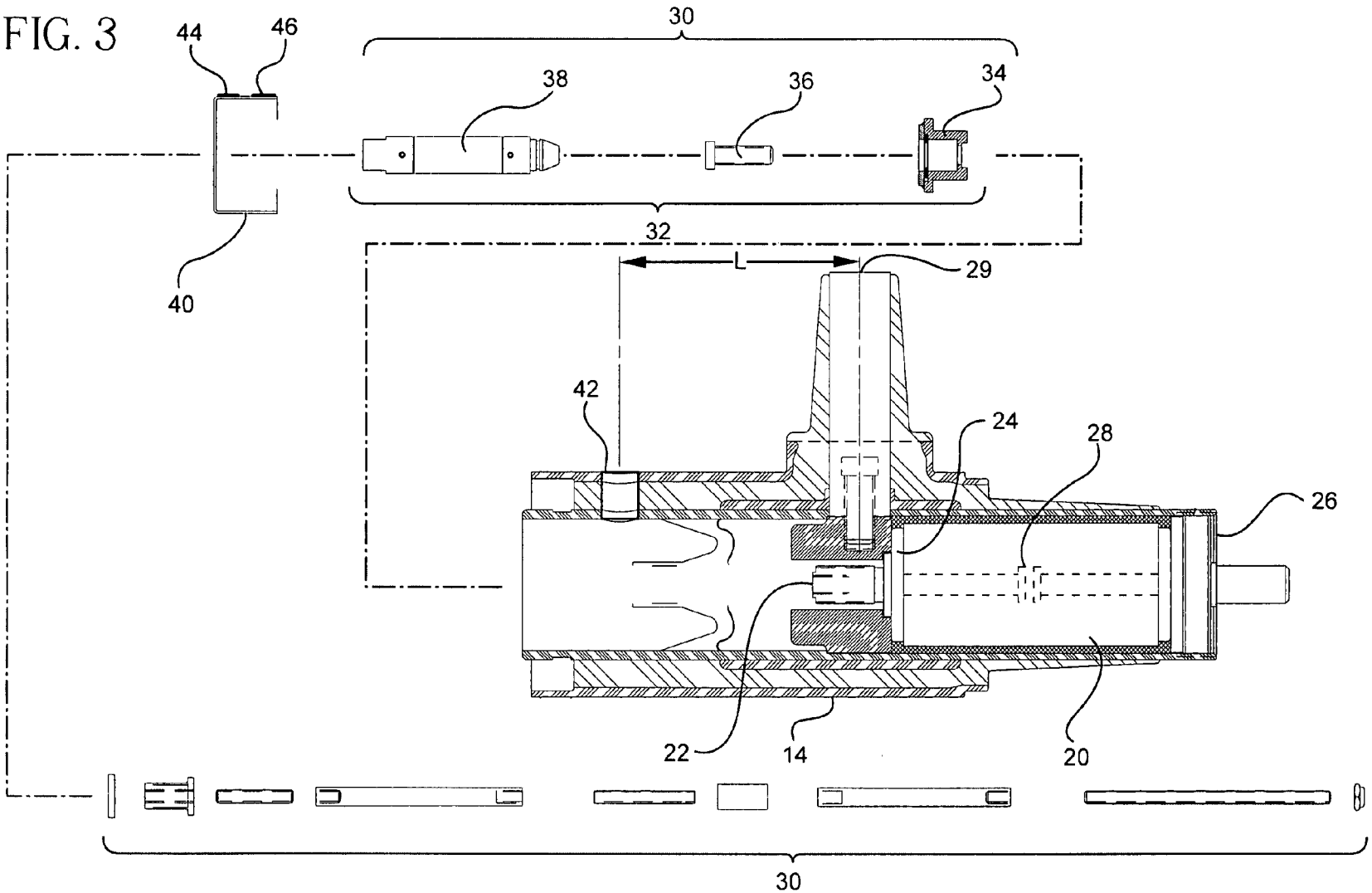
FIG. 3 is a sectional view of the visible open indicator illustrated in FIG. 2 with an exploded view of the actuating mechanism and indicator.

FIGS. 2 and 3 show an embodiment of the present invention in which a vacuum bottle 20 is attached to a housing 14 to form a switch or interrupter assembly 10. The vacuum bottle 20 contains a contact 28 and has a first end 24 that connects to a voltage source and a second end 26 that connects to a load. An actuating element 22 on the first end 24 connects to the actuating mechanism 30 for either a switch or interrupter. In a preferred embodiment, the actuating mechanism 30 includes an assembly 32 that has a snap connector 34, a screw 36 and an insulated rod 38. The snap connector 34 is secured to the actuating element 22, preferably with a screw 36, and the insulated rod 38 is attached to the snap connector 34. An indicator 40 for the contact 28 is then attached to the insulated rod 38. Preferably, the indicator has a red portion 44 (for indicating the contact 28 is closed) and a green portion 46 (for indicating the contact 28 is open).

A viewing window 42 extends through the housing 14 so that, when the actuating mechanism opens or closes the contact 28, the red portion 44 or green portion 46 of the indicator 40 is aligned with the viewing window 42 and shows the position of the contact 28. In a preferred embodiment, the housing 14 is made from a solid dielectric material and the viewing window 42 is located in an aperture 41 in the wall 43 of the housing 14. The viewing window 42 is located as close as possible to the centerline of the inlet connection 29 for the load in order to minimize the number of components in the actuating mechanism 30 between the actuating element 22 and the indicator 40. Preferably, the distance (L) between the centerline of the viewing window 42 and the centerline of the inlet connection 29 is less than 6 inches and most preferably less than 5 inches.

Figure 4:
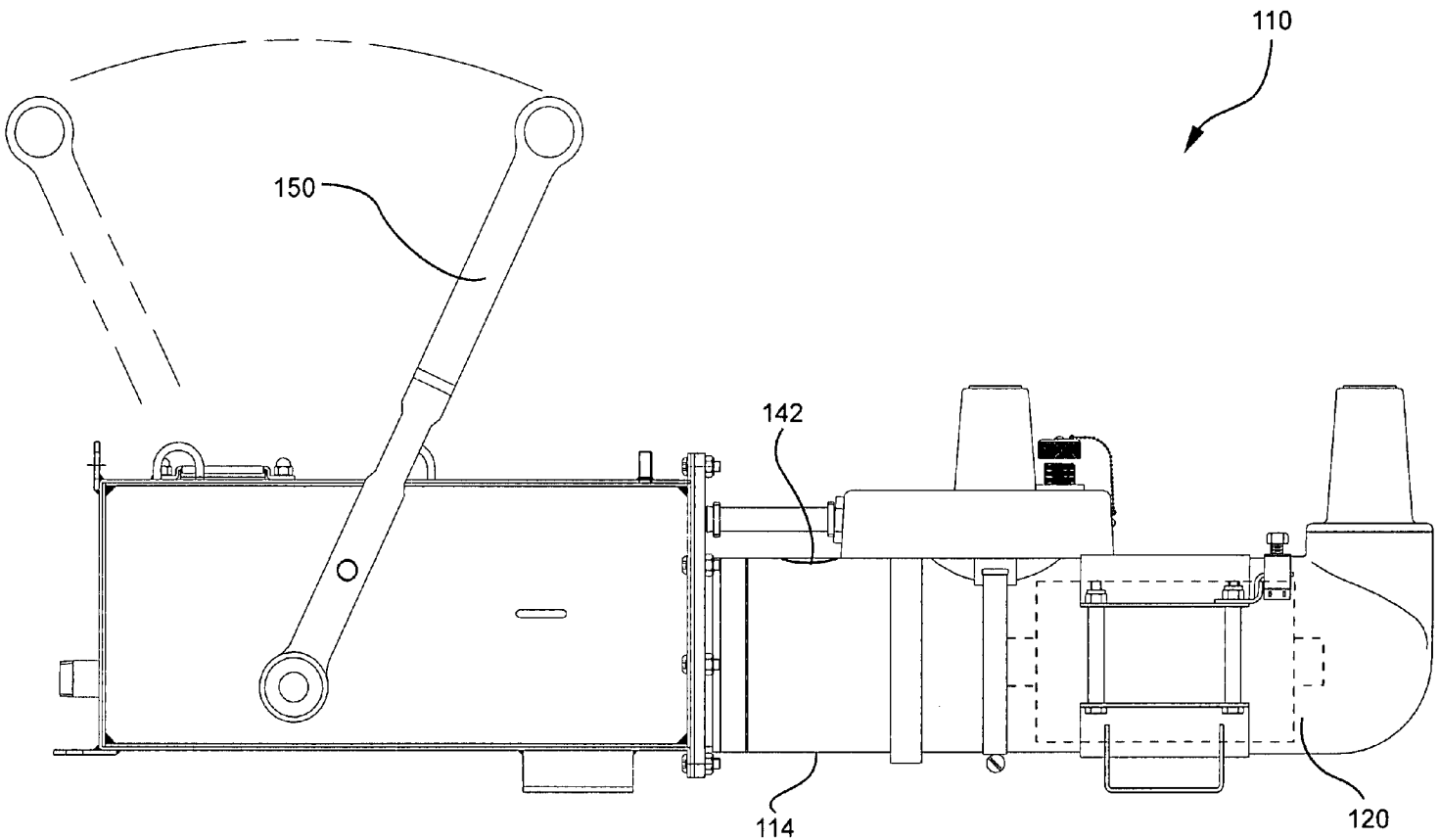
FIG. 4 is a side view of an interrupter with a viewing window.
Figure 5:
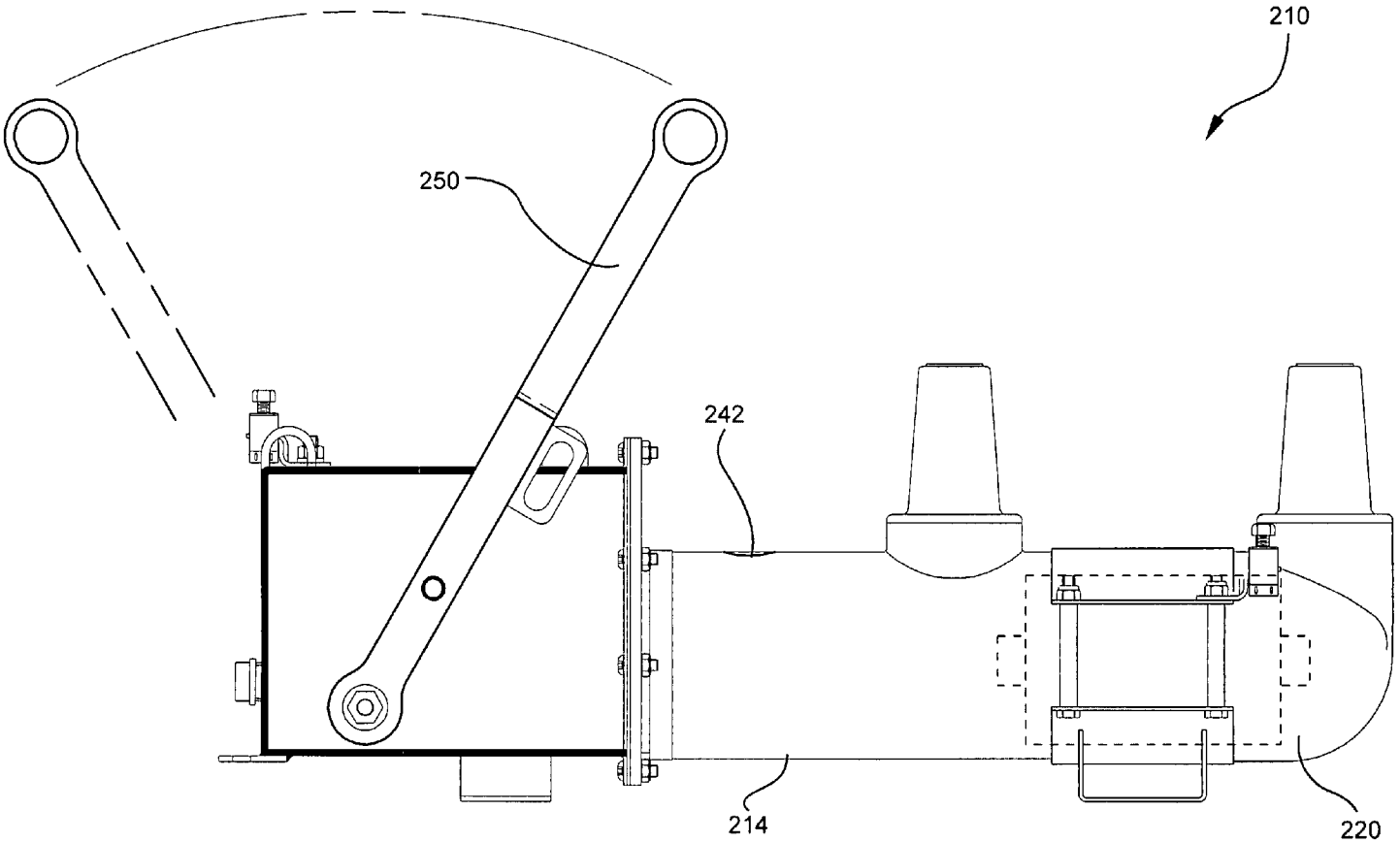
FIG. 5 is a side view of a switch with a viewing window.

FIG. 4 shows an interrupter assembly 110 with an operating handle 150 which is connected to the actuating mechanism for opening and closing the contact 28 (see FIG. 3). The viewing window 142 extends through the housing 114 in close proximity to the vacuum bottle 120. Similarly, FIG. 5 shows a switch assembly 210 with an operating handle 250 which is connected to the actuating mechanism for opening and closing the contact. The viewing window 242 in the housing 214 is located a between the operating handle 250 and the vacuum bottle 220. The viewing window 242 can also be located at any position on the circumference of the housing 214. This allows the viewing window 242 to be observed from different angles.

Thus, while there have been described the preferred embodiments of the present invention, those skilled in the art will realize that other embodiments can be made without departing from the spirit of the invention, and it is intended to include all such further modifications and changes as come within the true scope of the claims set forth herein.

We claim:

1. A visible open and closed indicator assembly for high voltage vacuum interrupters and switches that use a vacuum bottle having a high voltage contact and an actuating element that opens and closes the contact, the visible open indicator assembly comprising:

a linear and non-pivotal actuating mechanism that operates the actuating element;

a housing that contains the actuating mechanism;

an indicator attached to the actuating mechanism, the indicator comprising a first indicating portion and a second indicating portion, wherein the first indicating portion of the indicator shows that the high voltage contact is in an open position and the second indicating portion of the indicator shows that the high voltage contact is in a closed position;

a viewing window extending through the housing, wherein the viewing window is aligned with the indicator so that the first and second indicating portions of the indicator can be viewed through the viewing window, wherein the indicator moves in a linear direction away from the vacuum bottle when the actuating mechanism operates the actuating element to open the contact and the indicator moves in a linear direction towards the vacuum bottle when the actuating mechanism operates the actuating element to close the contact.

2. The visible open and closed indicator assembly for high voltage vacuum interrupters and switches according to claim 1, wherein the actuating mechanism comprises a linkage formed by a plurality of components.

3. The visible open and closed indicator assembly for high voltage vacuum interrupters and switches according to claim 1, wherein the first indicating portion is visible through the viewing window when the contact is open and the second indicating portion is visible through the viewing window when the contact is closed.

4. The visible open and closed indicator assembly for high voltage vacuum interrupters and switches according to claim 1, wherein the actuating mechanism comprises a first end and a second end, and wherein the actuating mechanism is connected to the actuating element on the first end and a handle on the second end.

5. The visible open and closed indicator assembly for high voltage vacuum interrupters and switches according to claim 1, wherein the actuating mechanism comprises an assembly that connects the indicator to the actuating element.

6. The visible open and closed indicator assembly for high voltage vacuum interrupters and switches according to claim 5, wherein the assembly comprises a connector and an insulated rod.

7. The visible open and closed indicator assembly for high voltage vacuum interrupters and switches according to claim 5, wherein the assembly consists essentially of a connector, a screw and an insulated rod.

8. The visible open and closed indicator assembly for high voltage vacuum interrupters and switches according to claim 1, wherein the housing is constructed from a solid dielectric material.

9. The visible open and closed indicator assembly for high voltage vacuum interrupters and switches according to claim 1, wherein the housing is constructed from EPDM rubber.

10. The visible open and closed indicator assembly for high voltage vacuum interrupters and switches according to claim 1, wherein the high voltage vacuum interrupters and switches comprise a voltage inlet connection having a first centerline and wherein the viewing window has a second centerline that is less than 6 inches from the first centerline.

11. The visible open and closed indicator assembly for high voltage vacuum interrupters and switches according to claim 3, wherein the housing is made from a solid dielectric material.

12. A visible open and closed indicator assembly for high voltage vacuum interrupters and switches that use a vacuum bottle having a high voltage contact and an actuating element that opens and closes the contact, the visible open indicator comprising:

a linear and non-pivotal actuating mechanism that operates the actuating element;

a housing that contains the actuating mechanism;

an indicator attached to the actuating mechanism, wherein the indicator comprises a first indicating portion and a second indicating portion;

a viewing window extending through the housing, wherein the viewing window is aligned with the indicator so that the indicator is viewable through the viewing window, wherein the indicator moves in a linear direction away from the vacuum bottle when the actuating mechanism operates the actuating element to open the contact and the indicator moves in a linear direction towards the vacuum bottle when the actuating mechanism operates the actuating element to close the contact and wherein the first indicating portion is visible through the viewing window when the contact is open and the second indicating portion is visible through the viewing window when the contact is closed.

13. The visible open and closed indicator assembly for high voltage vacuum interrupters and switches according to claim 12, wherein the high voltage vacuum interrupters and switches comprise a voltage inlet connection having a first centerline and wherein the viewing window has a second centerline that is less than 6 inches from the first centerline.

14. The visible open and closed indicator assembly for high voltage vacuum interrupters and switches according to claim 12, wherein the housing is constructed from a solid dielectric material.

15. The visible open and closed indicator assembly for high voltage vacuum interrupters and switches according to claim 12, wherein the actuating mechanism comprises a first end and a second end, and wherein the actuating mechanism is connected to the actuating element on the first end and a handle on the second end.

16. A visible open and closed indicator assembly for high voltage vacuum interrupters and switches that use a vacuum bottle having a high voltage contact and an actuating element that opens and closes the contact, the visible open indicator comprising:

a linear and non-pivotal actuating mechanism that operates the actuating element;

a housing that contains the actuating mechanism, wherein the housing is constructed from a solid dielectric material;

an indicator attached to the actuating mechanism, the indicator comprising a first indicating portion and a second indicating portion, wherein the first indicating portion shows that the contact is in an open position and the second indicating portion shows that the contact is in a closed position;

a viewing window extending through the housing, wherein the viewing window is aligned with the indicator so that the first and second indicating portions of the indicator can be viewed through the viewing window, wherein the high voltage vacuum interrupters and switches comprise a voltage inlet connection having a first centerline and wherein the viewing window has a second centerline that is less than 6 inches from the first centerline and wherein the indicator moves in a linear direction away from the vacuum bottle when the actuating mechanism operates the actuating element to open the contact and the indicator moves in a linear direction towards the vacuum bottle when the actuating mechanism operates the actuating element to close the contact.

17. The visible open and closed indicator assembly for high voltage vacuum interrupters and switches according to claim 16, wherein the actuating mechanism comprises a first end and a second end, and wherein the actuating mechanism is connected to the actuating element on the first end and a handle on the second end.

18. The visible open and closed indicator assembly for high voltage vacuum interrupters and switches according to claim 16, wherein the solid dielectric material is EPDM rubber.

* * * * *